US005647908A

United States Patent [19]

Hausmann et al.

[11] Patent Number: 5,647,908

[45] Date of Patent: Jul. 15, 1997

[54] APPLICATOR FOR SURFACE TREATMENT AGENT FOR CONTINUOUS CASTING PROCESS

[75] Inventors: Henry A. Hausmann, Strongsville; Robert O. Lindstrom, Bay Village, both of Ohio; Thomas J. Russo, Kingsville, Md.

[73] Assignee: Foseco International Limited, Birmingham, England

[21] Appl. No.: 388,687

[22] Filed: Feb. 15, 1995

[51] Int. Cl.[6] ..... B05B 7/00; B05B 7/14

[52] U.S. Cl. ..... 118/308; 164/268

[58] Field of Search ..... 118/308, 301, 118/310, 311, 312; 222/575, 610, 611.1, 566, 526; 164/452, 267, 268; 427/196, 180; 239/78, 151, 311, 562, 563, 564, 601

[56] References Cited

U.S. PATENT DOCUMENTS

| | | | |
|---|---|---|---|
| 339,454 | 4/1886 | McWhorter | 222/526 |
| 1,445,049 | 2/1923 | Stuart | 239/601 |
| 2,242,182 | 5/1941 | McCann | 118/310 |
| 2,792,780 | 5/1957 | Jacob | 118/301 |
| 3,843,029 | 10/1974 | Bezzecchi | 222/566 |
| 3,900,065 | 8/1975 | Giunta et al. | 164/420 |
| 3,967,004 | 6/1976 | Oda et al. | 427/196 |
| 3,970,135 | 7/1976 | Schmid et al. | 164/452 |
| 4,478,896 | 10/1984 | Barnes et al. | 427/196 |
| 4,542,040 | 9/1985 | Nowak | 118/308 |
| 4,561,572 | 12/1985 | Grundler | 222/410 |
| 4,595,045 | 6/1986 | Mangin et al. | 164/472 |
| 5,158,129 | 10/1992 | Hubert et al. | 164/452 |
| 5,409,733 | 4/1995 | Boger et al. | 427/96 |

OTHER PUBLICATIONS

Webster's II New Riverside University Dictionary The Riverside Publishing Company, 1994, p. 314.

*Primary Examiner*—Jill Warden
*Assistant Examiner*—Alexander Markoff
*Attorney, Agent, or Firm*—Nixon & Vanderhye P.C.

[57] ABSTRACT

An applicator spreads a treatment agent, such as flux powder or granules, uniformly on the surface of molten metal during continuous casting. The flux is supplied to the applicator and argon or other gas under pressure is also supplied adjacent the applicator in at least two directions. A programmable controller controls the gas feed in each of the directions so that each gas flow is independently controllable. The applicator preferably is a frusto-triangular-shaped pan having a narrow end and a wider end with the narrow end connected to the supply of flux. The applicator is supported by a base having an upper surface with a series of channels defined by vanes so that the flux is divided along the channels and then exits at the wider end of the applicator. The base is either flat or domed.

21 Claims, 4 Drawing Sheets

FIG. 2.
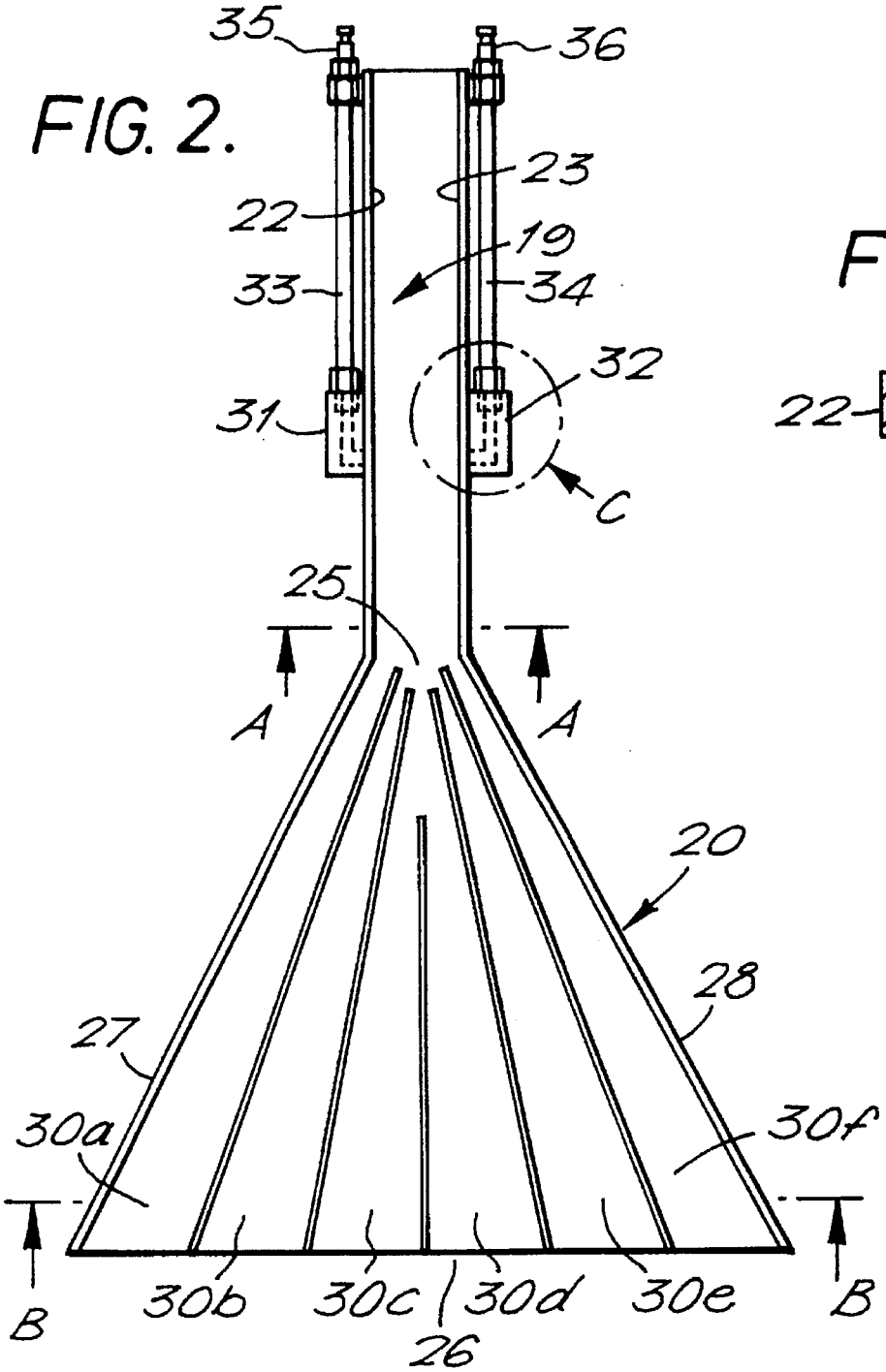
FIG. 3.
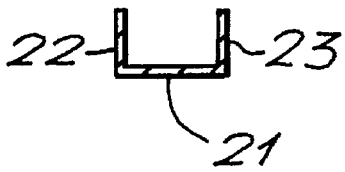
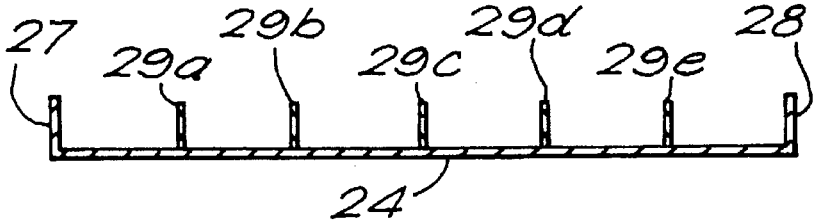
FIG. 4.

APPLICATOR FOR SURFACE TREATMENT AGENT FOR CONTINUOUS CASTING PROCESS

BACKGROUND AND SUMMARY OF THE INVENTION

This invention relates to an applicator to spread a treatment agent uniformly on the surface of molten metal in a continuous casting process. It is particularly concerned to provide an applicator to spread mold flux on to the molten metal surface in a continuous slab casting process and will be more specifically described below with particular reference to such a process.

In the casting process, flux must be applied across the surface of the molten metal in the casting mold in a uniform manner regardless of the surface area of the mold. Conventionally, this operation is carried out manually. Flux powder or granules are deposited in piles on the mold cover and are pushed in to the mold by an operator using, for example, a hoe-like tool. The operator is responsible for maintaining, so far as possible, the correct flux level over the entire mold cavity surface.

In a known alternative method, the flux is spread into the mold cavity via a fixed pipe and through a spreader tip or applicator attached to the end of the pipe. This method has not proved entirely satisfactory in that it has been found difficult to deal efficiently with any localized 'hot spot' and, in this respect, the entirely manual conventional system appears to be better.

It is an object of the invention to provide an improved automated process to maintain a uniform covering of treatment agent, e.g. flux, on the surface of molten metal in a mold cavity.

Accordingly, in one aspect, the invention provides an apparatus to supply treatment agent at a treatment station, which comprises an applicator to spread the agent into the treatment station, agent feed means to supply the agent to the applicator, pressurized gas feed means outletting adjacent the applicator in at least two directions and control means for the gas feed means to enable the gas feed in each said direction to be independently controlled.

The treatment agent is preferably in granulated form but may have other physical form e.g. a powder.

The applicator is preferably a frusto-triangular shaped pan in plan whose narrow end is connected to the agent feed means. The pan is preferably flat-bottomed with a series of channels defined by vanes on its upper surface so that the flow of treatment agent is divided along those channels and then exits at the wider end of the pan. Alternatively, the bottom of the pan may be, for example, corrugated or domed.

The gas feed means preferably outlet into or somewhat before the narrow end of the pan to control the distribution of the treatment agent into the various channels.

The agent feed means is preferably a stainless steel tube connected to a hopper containing the treatment agent. Conventional means may conveniently be employed to supply the hopper with treatment agent and to deliver the treatment agent from the hopper to the agent feed means and then the applicator.

In another aspect the invention provides an apparatus to supply treatment agent to a treatment station which comprises an applicator to spread the agent at the treatment station, an agent feed means comprising a tube from a source of the agent, a trough to receive the end of the tube remote from the source, the trough leading into the applicator and a wedge-shaped distributor positioned in the trough with its narrow end towards the tube and its wider end towards the applicator whereby the agent passing through the trough is spread out across its width.

The wedge-shaped distributor may, for example, be attached to the base of the trough, but in a preferred embodiment, is suspended above the base.

In another aspect the invention provides an applicator to supply treatment agent to a treatment station, the applicator being of generally frusto-triangular plan shape so as to have a narrow end and a wider end, and being adapted to be connected at its narrow end to a means of supply of the treatment agent, the surface of the applicator over which the agent is to flow comprising a series of open channels, the channels widening from the narrow end to the wider end of the applicator.

As indicated above, the applicator may be, for example, flat-bottomed, domed or corrugated. When it is of corrugated form, the corrugations may conveniently define the desired channels. When it is flat-bottomed or domed, the channels may conveniently be provided by vanes upstanding from its upper surface.

As indicated above, the treatment station will preferably be the mold cavity of a continuous slab caster and the treatment agent is preferably a flux to be applied to the molten metal surface in the mold cavity.

In a preferred embodiment there are two outlets for the pressurized gas, one at each side of the applicator pan. The gas feed may conveniently be delivered from a conventional pressurized source to pass along two tubes attached along opposite sides of the steel tube feed means for the treatment agent. A dry gas, preferably an inert gas, e.g. argon, is used as the pressurized gas.

In the preferred embodiment, therefore, the gas outlets are provided to direct the gas at the right-hand side and left-hand side of the applicator pan. The right-hand gas outlet or jet is arranged to blow the treatment agent towards the left side of the applicator and the left-hand jet is arranged to blow the treatment agent towards the right side of the applicator. The control means for the gas outlets may be manual or a programmed controller. The direction and amount of gas flow is thereby controlled to ensure the desired distribution of treatment agent across the applicator and, hence, across the mold cavity.

Thus, the invention provides a multiplicity of means to ensure the desired uniform distribution of flux.

Firstly, the wedge-shaped distributor located in the connecting trough between the tube feed means and the applicator spreads out the flux emerging from the tube more evenly across the trough and hence it is more evenly distributed as it enters the applicator.

Secondly, the applicator with its frusto-triangular or fan-shape, widening from its inlet to its outlet and with its widening channels also helps to ensure a good spread of the flux as it emerges from the applicator.

Thirdly, the gas feed means enable the distribution of the flux to be varied to meet specific needs as they arise or to be distributed according to a preferred, pre-determined pattern.

Where the wedge-shaped distributor is used in addition to the applicator and the gas feed means, it will be found advantageous to position the gas outlets to operate into the trough in the region between the distributor and the applicator.

BRIEF DESCRIPTION OF THE DRAWINGS

The invention will be further described by way of example only with reference to the accompanying drawings in which:

FIG. 2 is a diagrammatic representation showing an applicator of the invention, a trough to receive flux and gas outlet means;

FIG. 3 is a section on line A—A of FIG. 2;

FIG. 4 is a section on line B—B of FIG. 2.

DETAILED DESCRIPTION OF THE DRAWINGS

Figure 1:
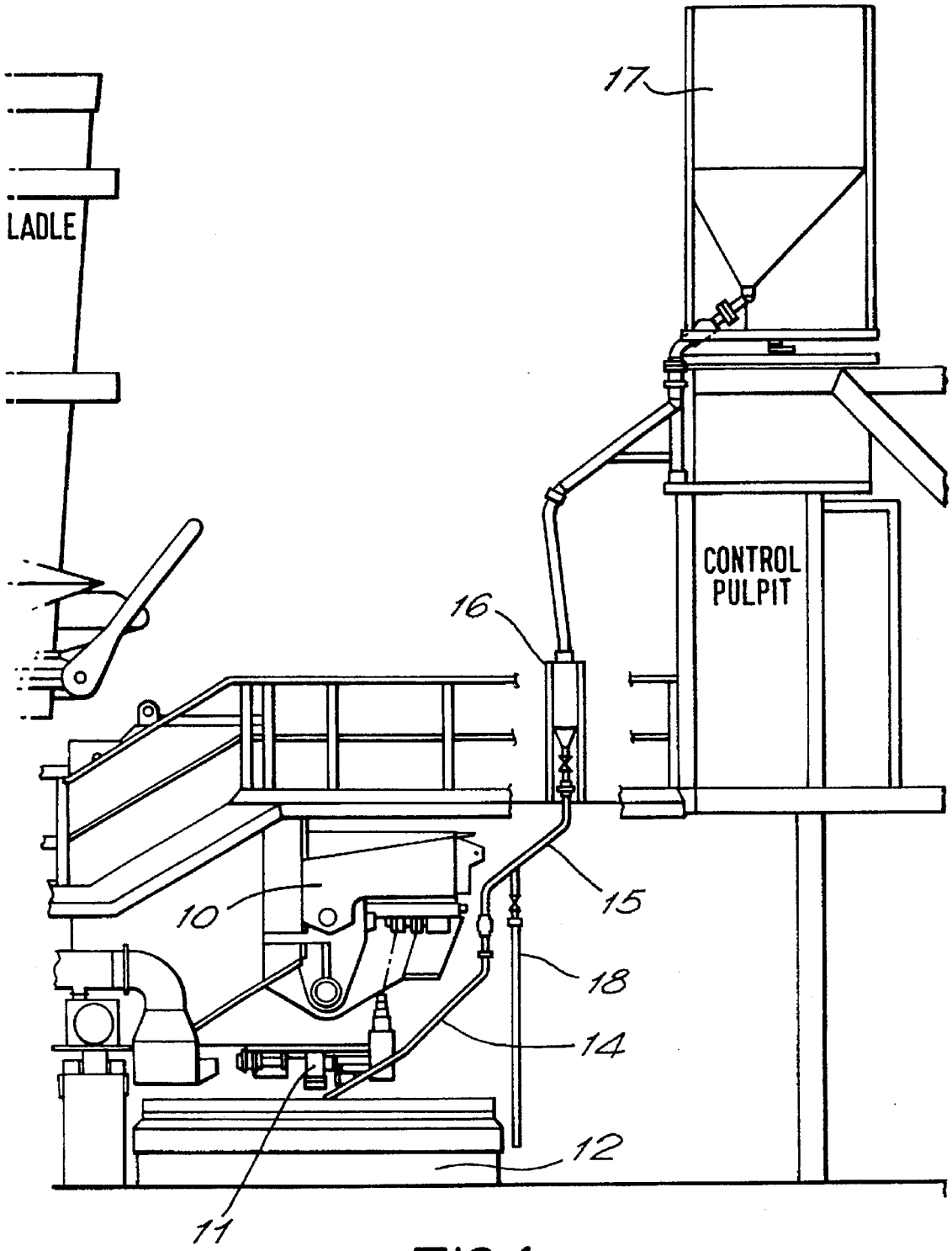
FIG. 1 is a schematic arrangement showing means to supply flux to a casting slab mold beneath a tundish.

In FIG. 1, a tundish 10 feeds molten steel through an outlet 11 having a slidegate valve (not shown) to a continuous casting mold 12. Flux granules are supplied to the surface of the molten steel in the mold 12 via a steel tube 14, which is connected via an intermediate tube 15 to a hopper 16, which in turn is fed with flux from a main hopper 17. Intermediate tube 15 is branched and can supply flux either to the steel tube 14 or via a flexible hose 18. As shown in FIG. 1, the flexible hose 18 is not in use and, hence, the flux supply is directed through the steel tube 14.

Steel tube 14 is connected at its outlet end to means of the invention shown in greater detail in FIGS. 2, 3 and 4. The means comprises a trough 19 which is attached at one end to a fan-shaped applicator 20 and at its other end to tube 14 (not shown in FIG. 2). The trough 19 is of rectangular cross-section having a flat base 21 and upstanding sidewalls 22 and 23 (FIG. 3). In use the trough will normally be provided with a cover (not shown) so as to form a completely enclosed passageway through which the flux travels into the applicator 20.

As shown in FIGS. 2 and 4, applicator 20 has a base 24 over which the flux travels and widens from a narrow end 25 connected to the trough 19 to its outlet end 26. The base has two upstanding sidewalls 27 and 28 and five intermediate upstanding vanes 29*a, b, c, d, e*. The sidewalls and vanes define between them six channels 30, *a, b, c, d, e, f*. Each channel widens as it goes from end 25 to end 26 of applicator 20.

Attached to sidewalls 22 and 23 of trough 19 partway along its length are gas outlet blocks 31 and 32 respectively. These are described in greater detail below with reference to FIGS. 7 and 8. Each block is connected to a metal gas feed pipe 33, 34 and each feed pipe has at its end remote from the gas outlet a quick-connect, snap-fitting connector 35, 36 for connection to a source of gas, e.g. argon, (not shown).

Figure 5:
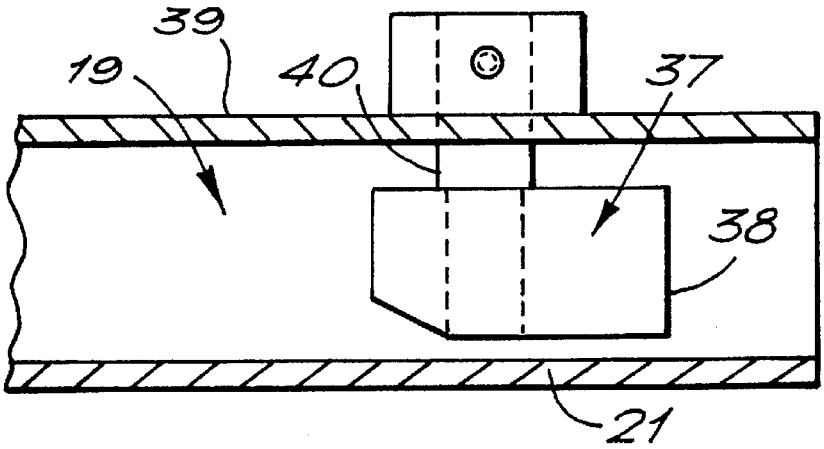
FIG. 5 is a side view of the interior of a portion of a trough used in the invention showing the location of a distributor wedge.
Figure 6:
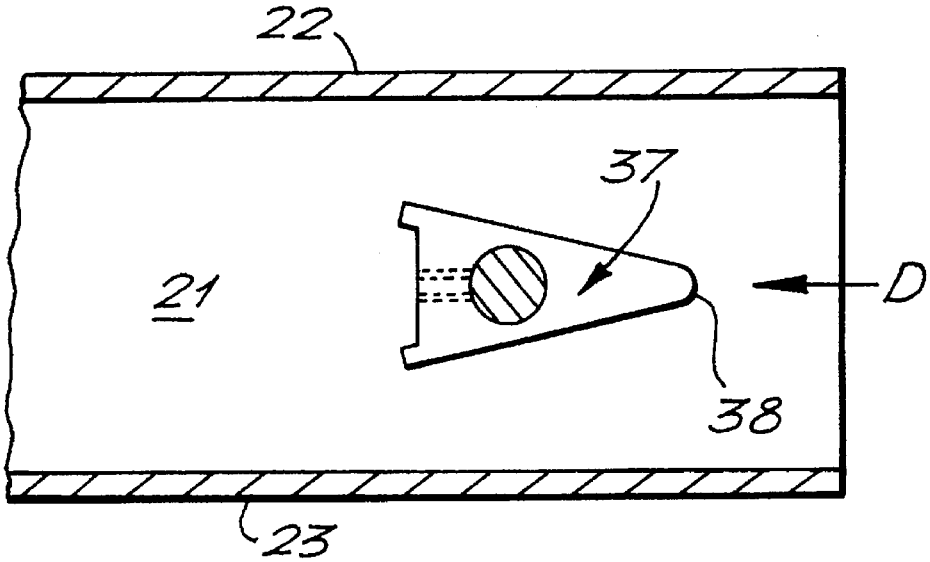
FIG. 6 is a plan view corresponding to the view of FIG. 5.

Referring now to FIGS. 5 and 6, there is shown the use of a wedge-shaped distributor suspended in the trough 19. As shown in FIG. 6, the distributor 37 is wedge-shaped in plan form with its narrow but rounded end 38 facing the incoming flux flowing in the direction of arrow D. The distributor is centrally positioned above base 21 of the trough 19 between sidewalls 22 and 23. It is suspended from the cover 39 of the trough by a pin 40 so that some flux can flow in the relatively small gap underneath it i.e. between it and floor 21, and, most importantly, some is directly outwardly towards sidewalls 22 and 23. By this means good distribution of the flux across the width of the trough is ensured even though the outlet of feed tube 14 may be of smaller diameter than the width of the trough.

Figure 7:
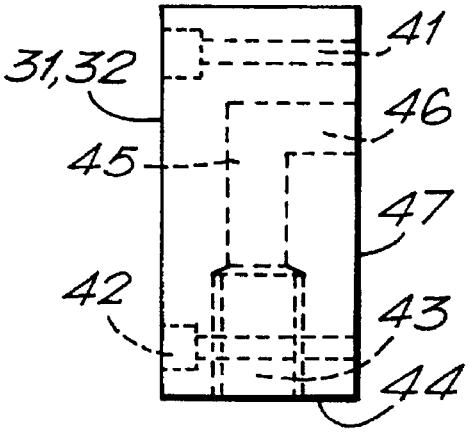
FIG. 7 is an enlarged view of the area C of FIG. 2 showing one of the gas outlets in more detail.
Figure 8:
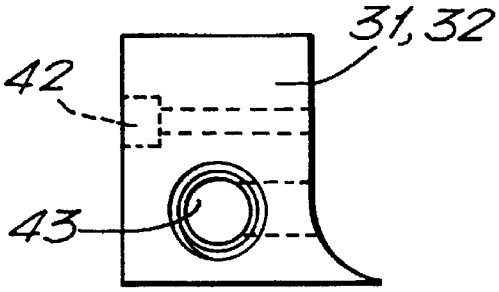
FIG. 8 is an end view of the gas outlet of FIG. 7 taken from the source.

Returning now to the gas outlets, one of these is shown in grater detail in FIGS. 7 and 8.

Each gas outlet block 31 or 32 is attached to its respective trough sidewall 22 or 23 by conventional attachment means indicated at 41 and 42. Gas pipe 33 or 34 feeds into an appropriately shaped recess 43 in end face 44 of the block. Recess 43 leads into longitudinal passageway 45 which connects at right angles with passageway 46 which exits at side face 47 of the block through a corresponding hole in the trough sidewall 22 or 23. By this means gas fed to the outlet blocks 31, 32 is directed across the width of the trough. (It may be found, for example, that an angle different from 90° between the two passageways may be preferable for certain treatment agents but this would be a matter of routine experimentation for the average skilled man of the art.)

In operation, molten steel from tundish 10 is run into mold 12 and when the surface of the steel reaches the desired level it is covered with a layer of flux provided from hoppers 16 and 17 via intermediate tube 15. The operator has a choice in that it may be preferred to provide the initial flux covering layer across the whole of the surface of the molten metal in the mold by means of the flexible delivery tube 18, which is long enough to enable this to be done. If this option is chosen, the applicator means of the invention are then used later to maintain the uniformity of the flux layer during the continuous casting process, i.e. the flux outlet via tube 14 replaces that via tube 18 after the initial covering layer is applied and the operator applies further flux as and when needed by the means of the invention. The alternative is that the applicator means of the invention are used both to form the initial covering layer and to apply any further flux as and when needed. In this mode, the flexible delivery tube 18 is only used as a back-up e.g. in emergency.

Normally, depending on the size of the mold, it will be found necessary to have more than one applicator means of the invention. In most applications, it will be found convenient to have two, one spaced each side of the outlet from the tundish to the mold, so as to effectively cover the entire width of the mold. However, for convenience, the invention has been described with reference to the drawings showing one applicator only of the invention.

As the steel casting process develops the operator can control flux application by conventional manual control means for the gas supply to direct the flux in greater concentration to one side of the applicator or the other as is required by applying gas pressure through one or other of the outlets. Alternatively, or in addition to manual control, the control means may be automatically pre-programmed as indicated previously. Again the actual control means will be conventional means to allow gas to flow from one or other or both outlets in a predetermined order and for a predetermined time.

Regardless of whether manual or automatic control means are being used, it is preferred that the center position of the controls should be set so that both the left and right hand gas supplies are effectively switched off and it will be found convenient to have a small "dead band" or zero gas pressure position on either side of the center position. Moving the controls further either way beyond that dead band is then arranged to gradually increase the gas pressure at that side from zero up to the maximum desired pressure, which may conveniently be, for example, 2 p.s.i.

A typical pre-programmed sequence for the applicator gas jets could be as follows, although of course, any specific required sequence would need to be determined in the light of the particular operating conditions employed.

1. Both left and right gas jets off at startup. (The powder will be evenly distributed across the length of the mold)

2. Left jet will gradually increase to maximum flow rate over "A" seconds. Where the value "A" is in seconds (0 to 60) (A gradual shift of powder slowly increasing to the right side)

3. Left jet will remain at maximum flow rate for "B" seconds. Where the value "B" is in seconds (0 to 60) (Powder flow favoring the right side)

4. Left jet will gradually decrease to zero (off) flow rate over "C" seconds. Where the value "C" is in seconds (0 to 60) (A gradual decrease of powder to the right, until flow is evenly distributed)

5. Both left and right gas jets will remain off for "D" seconds. Where the value "D" is in seconds (0 to 60) (The powder will be evenly distributed)

6. Right jet will gradually increase to maximum flow rate over "E" seconds. Where the value "E" is in seconds (0 to 60) (A gradual shift of powder slowly increasing to the left side)

7. Right jet will remain at maximum flow rate for "F" seconds. Where the value "F" is in seconds (0 to 60) (Powder flow favoring the left side)

8. Right jet will gradually decrease to zero (off) flow rate over "G" seconds. Where the value "G" is in seconds (0 to 60) (A gradual decrease of powder to the left until flow is evenly distributed)

9. Both left and right gas jets will remain off for "H" seconds. Where the value "H" is in seconds (0 to 60) (The powder will be evenly distributed)

10. The sequence will repeat itself back to step 2.

The sequence can be adjusted to suit the particular application by altering the above program timing elements ("A", "B", etc.).

Figure 9:
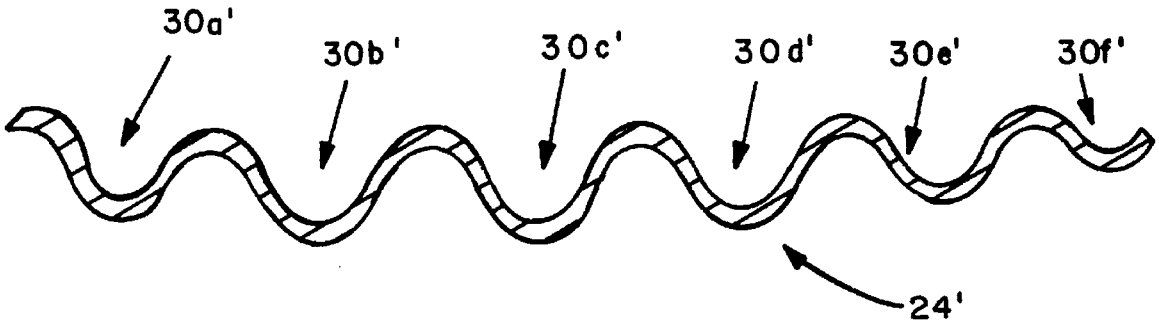
FIG. 9 is a view like that of FIG. 4 of a corrugated trough embodiment according to the present invention.
Figure 10:
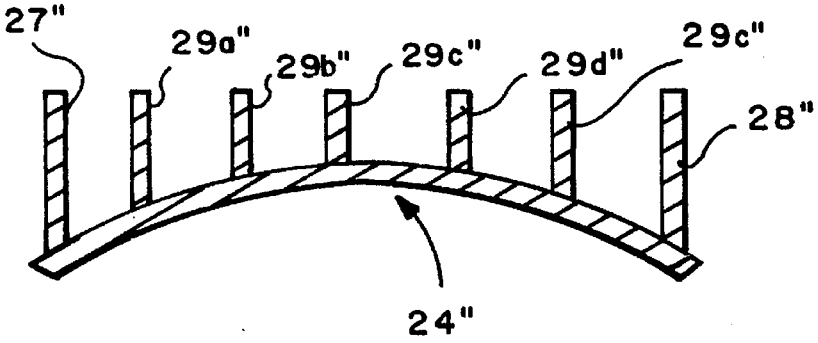
FIG. 10 is a view like that of FIG. 4 of a domed trough embodiment according to the present invention.

It will be appreciated that various modifications of the embodiments described may be made by the skilled man of the art without departing from the spirit and scope of the invention as herein claimed. For example instead of the base 24 of the applicator 20 being flat as illustrated in FIG. 4, it may be corrugated as illustrated at 24' in FIG. 9, to define the channels 30*a'*–30*f*. Alternatively the base could be domed, as indicated by base 24" in FIG. 10 with upstanding vanes 29"*a–e* defining the channels. Thus the invention is to be accorded the broadest interpretation of the appended claims to as to encompass all equivalent structures and apparatus.

What we claim is:

1. Apparatus to supply a particulate treatment agent onto the surface of molten metal of a continuous slab caster, said apparatus comprising an applicator for spreading the particulate treatment agent in particulate form onto said surface of molten metal of said continuous slab caster, agent feed means for supplying the particulate treatment agent to said applicator, gas feed means for supplying pressurized gas adjacent said applicator to enable gas feed in at least two directions so that the particulate treatment agent particles may be blown selectively to create a flow of the particulate treatment agent which flows in one or more direction to control the particulate treatment particles distribution over said molten metal surface, and control means for said gas feed means to enable said gas feed in each said direction to be independently controlled.

2. An apparatus according to claim 1, in which said particulate treatment agent feed means is adapted to supply said agent in granular form.

3. An apparatus according to claim 1, in which said applicator is a frusto-triangular-shaped pan in plan having a narrow end and a wider end, said narrow end being connected to said agent feed means.

4. An apparatus according to claim 3, in which said applicator has a base having an upper surface carrying a series of channels, said channels being defined by vanes on said upper surface, whereby said flow of the particulate treatment agent is divided along said channels and then exits at said wider end of said applicator.

5. An apparatus according to claim 4, in which said channels widen from said narrow end to said wider end of said applicator.

6. An apparatus according to claim 4, in which said base is flat.

7. An apparatus according to claim 4, in which said base is domed.

8. An apparatus according to claim 3, in which said applicator has a base having an upper surface carrying a series of channels, said channels being defined by corrugations of said base, whereby said flow of the particulate treatment agent is divided along said channels and then exits at said wider end of said applicator.

9. An apparatus according to claim 3, in which said gas feed means has at least one outlet adjacent said narrow end of said applicator.

10. An apparatus according to claim 1, wherein said gas feed means comprises two outlets for gas, one of said outlets being directed to supply gas in one direction across the flow of the particulate treatment agent and the other of said outlets being directed to supply gas in the opposite direction across the flow of the particulate treatment agent.

11. An apparatus according to claim 1, in which said agent feed means comprises a stainless steel tube connected to a hopper containing said particulate treatment agent.

12. An apparatus according to claim 11, in which said gas feed means comprises two tubes, each connected to a source of said gas, and attached along opposite sides of said stainless steel tube.

13. An apparatus according to claim 1, in which said gas feed means includes a source of argon.

14. An apparatus according to claim 12, in which said gas feed means include a source of argon.

15. An apparatus according to claim 1, in which said control means comprise a programmed controller.

16. Apparatus for supplying a treatment agent at a treatment station, said apparatus comprising:

an applicator for spreading the treatment agent into said treatment station;

agent feed means for supplying the treatment agent to said applicator;

gas feed means for supplying pressurized gas adjacent said applicator in at least two directions; and control means for said gas feed means for enabling gas feed in each of said at least two directions to be independently controlled;

said applicator comprising, in plan, a frusto-triangular shaped pan having a narrow end and a wider end, said narrow end connected to said treatment agent feed means; and wherein said gas feed means comprising outlets which are adjacent said narrow end of said applicator.

17. Apparatus for supplying a treatment agent to a treatment station, which comprises: an applicator for spreading the treatment agent at said treatment station; means for feeding the treatment agent to said applicator, said means comprising a source of the treatment agent, a tube from said source, and a trough to receive an end of said tube remote from said source, said trough leading into said applicator; and a distributor, said distributor wedge-shaped in plan, having a narrow end and a wider end, and positioned in said trough with said narrow end towards said tube, and said wider end towards said applicator, so that the treatment agent passing through said trough is spread out across the width of said trough; and pressurized gas feed means for feeding pressurized gas into said trough to create a flow of gas and having an outlet into said trough between said distributor and said applicator.

18. Apparatus as recited in claim 17 wherein said gas feed means comprises first and second outlets into said trough between said distributor and said applicator, said first outlet directed to blow gas across said trough in one direction, and said second outlet directed to blow gas across said trough in a second direction opposite said first direction; and further comprising control means for controlling said gas feed means so that the flow of gas in each of said directions can be independently controlled.

19. Apparatus as recited in claim 18 wherein said control means comprises a programmed controller.

20. Apparatus as recited in claim 17 wherein said trough has a base having an upper surface over which the treatment agent flows; and wherein said distributor is suspended above said base upper surface.

21. Apparatus as recited in claim 20 wherein said applicator comprises an uncovered base having an upper surface over which and in contact with which the treatment agent flows, said upper surface comprising a series of open channels widening from an end of said applicator closest to said distributor to an end of said applicator most remote from said distributor.

* * * * *